United States Patent [19]

Ogden

[11] Patent Number: 4,524,463

[45] Date of Patent: Jun. 25, 1985

[54] WRAP AROUND GARMENT

[76] Inventor: Danny W. Ogden, 1605 19th, Woodward, Okla. 73801

[21] Appl. No.: 417,077

[22] Filed: Sep. 13, 1982

[51] Int. Cl.[3] ..... A41D 1/22; A41B 9/14

[52] U.S. Cl. ..... 2/105; 2/76; 2/114

[58] Field of Search ..... 2/114, 74, DIG. 7, 105, 2/75, 76

[56] References Cited

U.S. PATENT DOCUMENTS

| | | | |
|---|---|---|---|
| 1,112,248 | 9/1914 | Baldwin | 2/76 |
| 1,849,578 | 3/1932 | Jackson | 2/74 |
| 2,051,444 | 8/1936 | Haister | 2/74 |
| 2,260,168 | 10/1941 | Costanza | 2/76 |
| 2,707,282 | 5/1955 | Paterson | 2/114 |
| 3,129,432 | 4/1964 | Belkin | 2/114 |
| 3,602,916 | 7/1971 | Aach | 2/76 |
| 4,215,434 | 8/1980 | Barron | 2/114 |

*Primary Examiner*—Doris L. Troutman

*Attorney, Agent, or Firm*—Head, Johnson & Stevenson

[57] ABSTRACT

A wrap-around garment having a main or single body encircling element adapted for wrapping around the body and securely fastening the front sections of the garment in an overlapped position to substantially eliminate accidental opening or dislodging of one wrapped section with respect to the other thus reducing embarrassment during wearing of the garment. The garment may be easily donned and removed by means of the use of the single body encircling fastening element.

5 Claims, 5 Drawing Figures

WRAP AROUND GARMENT

BACKGROUND OF THE INVENTION

1. Field of the Invention

This invention relates to improvements in garments and more particularly, but not by way of limitation, to an improved wrap-around garment.

2. Description of the Prior Art

Wrap-around garments are in widespread use in that they are usually relatively easy to put on and take off and are generally comfortable to wear. These garments have some disadvantages, however, in that they may fall open unless the overlapping portion covers an exceedingly great portion of the body. It will be apparent that the inadvertent separation of the overlapped portions of the garment may cause embarrassment. In addition, these garments frequently require two securing means, namely, an internal securing means and an external securing means. In some instances, internal strings or the like to be fastened together are provided in addition to external beltings or the like, which may be fastened together. In other garments of this type, one tying element or belt is adapted for insertion through a slit in another portion of the garment in order to pass around and tie with the other belt half or remaining tie member. Examples of garments of this type are shown in the Jacobs U.S. Pat. No. 1,903,403, issued Apr. 4, 1933 and entitled "Slip-On Garment"; Quinn U.S. Pat. No. 2,373,415 issued Apr. 10, 1945 and entitled "Wrap-Around Garment"; O'Brien U.S. Pat. No. 2,657,388, issued Nov. 3, 1953, and entitled "Reversible Front Garment"; Derrick U.S. Pat. No. 3,155,984, issued Nov. 10, 1964 and entitled "Fastenerless Examination Gown"; and the Simonoff U.S. Pat. No. 3,348,237 issued Oct. 24, 1967 and entitled "Reversible Wrap-Around Garment".

SUMMARY OF THE INVENTION

The present invention contemplates a wrap-around garment particularly designed and constructed for overcoming the foregoing disadvantages. The novel garment includes front sections adapted to be lapped over or wrapped around the front portion of the body, one of said front portions having a belt portion integral with or secured thereto which extends from the edge of said front section around the remaining portion of the torso and back over the outer portion of the same front section for fastening around the body of the wearer. This single fastening means integral with or secured to one of the garment front portions assures that a substantial elimination of inadvertent separation of the lapped-over front portions of the garment thus avoiding embarrasment. Of course, if desired, additional internal tie means may be provided but it is generally found that they are not necessary with the novel construction of the present garment. The novel wrap-around garment is simple and efficient in use and economical and durable in construction.

DETAILED DESCRIPTION OF THE PREFERRED EMBODIMENT

Figure 1:
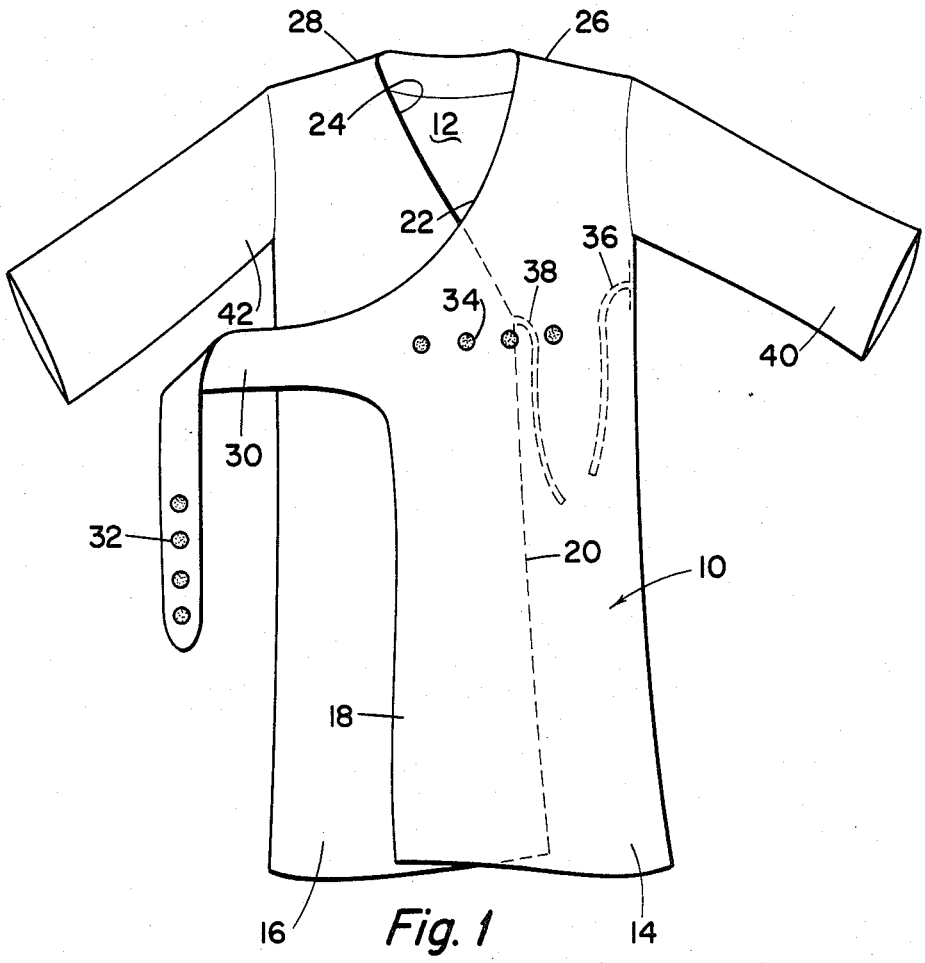
FIG. 1 is a front elevational view of a wrap-around garment embodying the invention and illustrated in an over-lapped position with the belt or securing means unfastened.

Referring to the drawings in detail, reference character 10 generally indicates a wrap-around garment comprising a back section 12 having a left front section 14 stitched or otherwise secured or integral with one longitudinal side edge thereof and a right front section 16 similarly secured to the opposite longitudinal side edge thereof. The front sections 14 and 16 are adapted to be placed atop one another or overlapped when the garment 10 is donned by a wearer or user 18 as will be hereinafter set forth.

Each front section 14 and 16 is preferably provided with a substantially straight free edge 18 and 20, respectively, adapted to be substantially vertically disposed when the garment 10 is worn. Each edge 18 and 20 preferably terinates at the upper portion thereof in an angularly disposed edge portion 22 and 24, respectively, extending from a point substantially in line with or above the waistline (not shown) of the garment 10 and in a direction toward the shoulder portions 26 and 28 of the garment.

One of the front sections, such as the left front section 14, is provided with a belt or body wrapping element 30 which may be secured to or integral with the section 14 substantially at the juncture between the edges 22 and 18. The belt or body wrapping element 13 is of a length at least sufficient to completely encircle the body of the wearer or user 18 and any suitable fastening means 32 and 34 is preferably positioned on the belt means 30 and left front portion 14, respectively, whereby the body encircling element 30 may be removably but securely fastened in the encircling position as will be hereinafter set forth. Whereas the fastening elements 32 and 34 as shown herein are preferably constructed from Velcro, a trademark of Velcro Corporation, it will be readily apparent that any suitable fastening means such as buttons, snaps, or the like may be utilized as desired.

It is not considered necessary to provide any other fastening means for assuring an efficient overlapping of the left and right front sections 14 and 16. However, if desired, auxiliary tie members 36 and 38 may be secured to the inner portion of the garment as for example, the tie 36 may be secured in the proximity of the side seam between the left front portion 14 and back portion 12 of the garment and the tie member 38 may be secured to the outer edge of the right front section 16 at the juncture between the edges 20 and 24 thereof as particularly shown in FIG. 1. Of course, if desired the garment 10 may also be provided with suitable left and right sleeves 40 and 42 as is well known in garments of this type.

Figure 3:
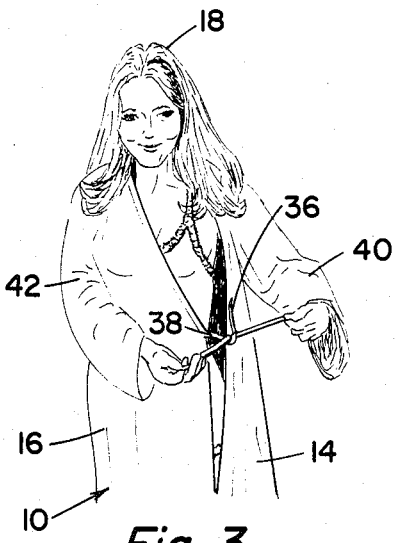
FIG. 3 is an elevational view of a wrap-around garment embodying the invention and illustrating a next succeeding step of placing the garment on a body.
Figure 2:
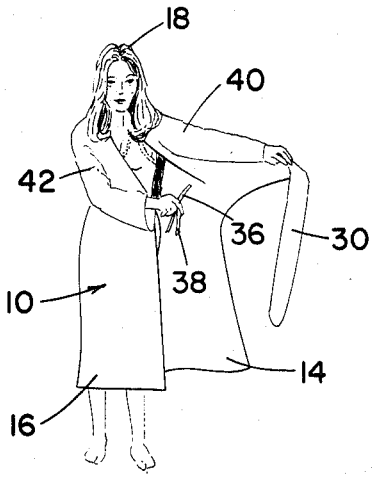
FIG. 2 is a partial elevational view of a wrap-around garment embodying the invention in an initial stage of securement around the body of a wearer.
Figure 5:
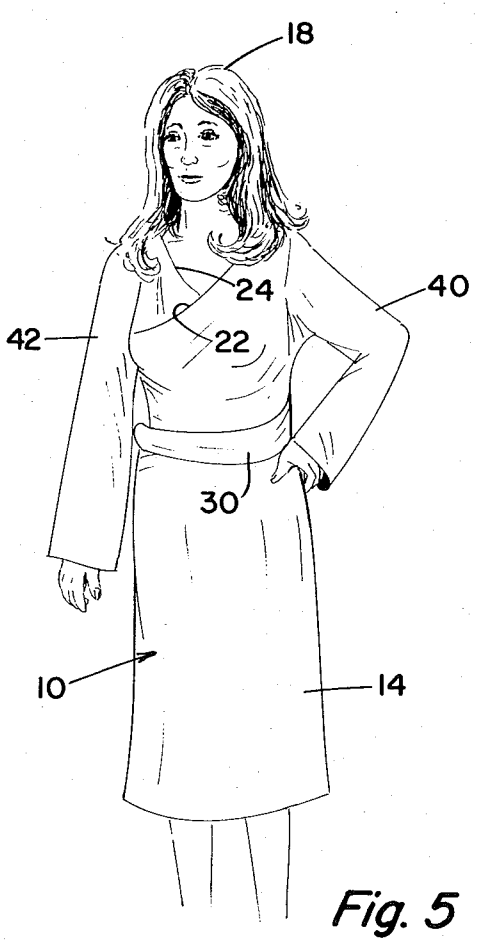
FIG. 5 is a partial elevational view of a wrap-around garment embodying the invention and shown as totally in place around a body.
Figure 4:
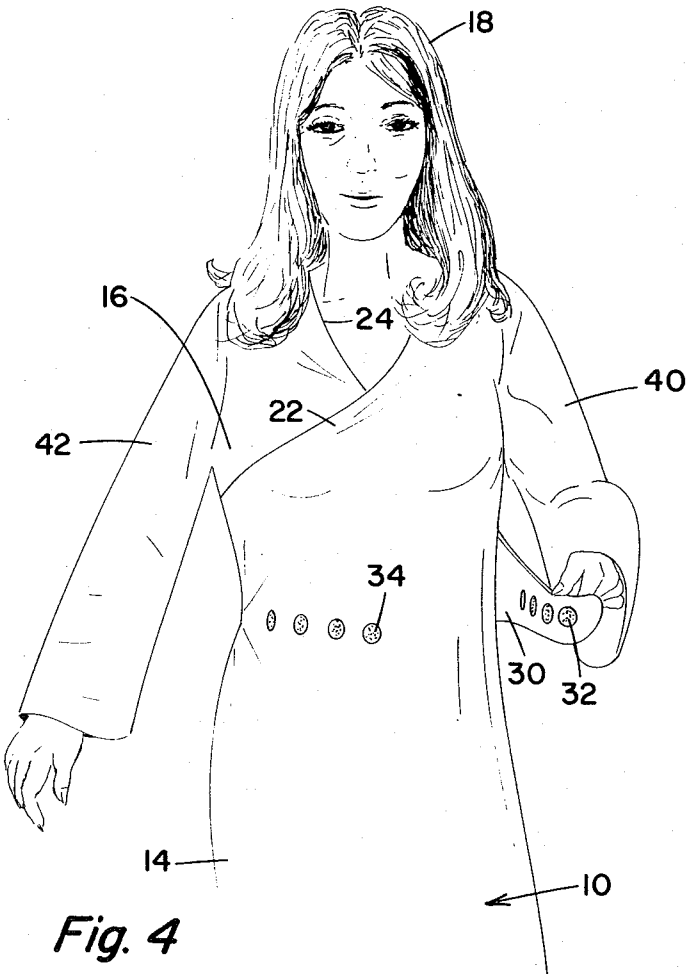
FIG. 4 is a partial elevational view of a next succeeding step in placing a wrap-around garment embodying the invention in position on a body.

In use, the garment 10 may be donned by the user 18 in any well known manner whereby the arms may be inserted through the sleeves 40 and 42 as is well known. One of the front sections such as the right section 16 may be placed against the front portion of the body as particularly shown in FIG. 2, and in the event the auxiliary tie means 36–38 are utuilized in the garment 10, the tie members may be fastened together in any suitable manner such as the usual simple knot as particularly shown in FIG. 3, thus bringing the left front section 14 into closer proximity with the right front section 16. The left front section 14 may then be lapped completely over or at least partially over the right front section 16 and the body encircling element 30 may be readily wrapped around the entire body in such a manner that the gripping elements 32 provided on the element 30 are brought into the proximity of the gripping members 34 provided on the front section 14 as shown in FIG. 4. It will be readily apparent that this step may be accomplished either with or without the application of the auxiliary tie means 36–38. When the gripping elements 32 and 34 have been engaged, the garment 10 will be efficiently wrapped and secured on the body of the user 18 as shown in FIG. 5. This single body encircling element 30 in combination with the configuration of the front sections 14 and 16, provide for a quick and easy donning of the garment and removal of the garment and in addition assure substantially no accidental unwrapping or unlapping of one front section with respect to the other to reduce any embarrassing display of the covered body portion.

From the foregoing it will be apparent that the present invention provides a novel wrap-around garment having a single body encircling element whereby the front portions of the garment may be readily overlapped and fastened into position by the body encircling means. The construction of the garment particularly assures maintaining the overlapped relationship between the front sections of the garment.

Whereas the present invention has been described in particular relation to the drawings attached hereto, it should be understood that other and further modifications, apart from those shown or suggested herein may be made within the spirit and scope of this invention.

What is claimed is:

1. A wrap-around garment comprising a back section having a right front section and left front section extending outwardly from opposite sides thereof, and a single body encircling means secured to only one of said front sections and extending transversely outwardly therefrom for wrapping completely around the body in a position against the outer surface only of the garment and securable in said wrapped position for securely retaining the front sections in an overlapping relationship during wearing of the garment.

2. A wrap-around garment as set forth in claim 1 wherein at least one of said front sections is provided with a free edge having a longitudinally extending portion and an angularly extending portion, and said body encircling means has one end disposed substantially at the juncture between the longitudinal and angular portions and the opposite end thereof extending outwardly therefrom.

3. A wrap-around garment as set forth in claim 2 wherein the body encircling means comprises a belt-like element, and complementary fastening means cooperating between the belt-like element and the said one front section for fastening the said one front section in an overlapping relationship with respect to the other front section.

4. A wrap-around garment as set forth in claim 3 wherein one longitudinal edge of the belt-like element is conterminous with and is a continuation of the angularly disposed portion of the free edge of said one front section.

5. A wrap-around garment as set forth in claim 1 and including auxiliary fastening means cooperating between one front section and the remaining portions of the garment for facilitating securing of the garment during wearing thereof.

* * * * *